United States Patent [19]

Shinzawa

[11] 4,313,415

[45] Feb. 2, 1982

[54] EXHAUST GAS RECIRCULATION SYSTEM IN COMPRESSION-IGNITION INTERNAL COMBUSTION ENGINE

[75] Inventor: Motohiro Shinzawa, Zushi, Japan

[73] Assignee: Nissan Motor Co., Ltd., Tokyo, Japan

[21] Appl. No.: 143,737

[22] Filed: Apr. 25, 1980

[30] Foreign Application Priority Data

Jun. 14, 1979 [JP] Japan ..... 54-81322[U]

[51] Int. Cl.[3] ..... F02M 25/06

[52] U.S. Cl. ..... 123/569; 123/571

[58] Field of Search ..... 123/569, 571, 568

[56] References Cited

U.S. PATENT DOCUMENTS 3,915,134 10/1975 Young et al. ..... 123/569
3,916,857 11/1975 Naito et al. ..... 123/569
4,020,809 3/1977 Kern et al. ..... 123/569
4,181,109 1/1980 Wake et al. ..... 123/569
4,237,837 12/1980 Toda et al. ..... 123/569
4,276,865 7/1981 Hamal ..... 125/568

*Primary Examiner*—Wendell E. Burns
*Attorney, Agent, or Firm*—Lane, Aitken, Kice & Kananen

[57] ABSTRACT

In an exhaust gas recirculation system of a compression ignition internal combustion engine, there are provided two passages, that is, an EGR passage for recirculation of exhaust gases and a by-pass passage by-passing the throttle valve in the induction passage to allow a supplemental air flow to the engine when EGR is cut off in definite engine operating conditions. These two passages are arranged to join together at a junction, in which there is provided a valve to open and close these two passages alternatively so that an adequate EGR control is performed in accordance with engine operating conditions with a simplified mechanism.

9 Claims, 3 Drawing Figures

EXHAUST GAS RECIRCULATION SYSTEM IN COMPRESSION-IGNITION INTERNAL COMBUSTION ENGINE

BACKGROUND OF THE INVENTION

This invention relates to a compression-ignition internal combustion engine, such as a diesel engine, equipped with an exhaust gas recirculation (EGR) system and more particularly relates to an intake system for making up for a deficiency in an intake air amount when EGR is cut off in a definite range of engine operating conditions.

In a conventional EGR system in a compression-ignition internal combustion engine, such as a diesel engine, a throttle valve is disposed in an intake passage to obtain a negative pressure downstream of the throttle valve and a portion of exhaust recirculation gases is sucked by the negative pressure for recirculation. The quantity of EGR is controlled in accordance with the magnitude of the negative pressure which is determined by the opening degree of the throttle valve.

In such an EGR system, exhaust gases are recirculated in accordance with the opening of the throttle valve without exception. However there are some engine operating conditions where EGR is not needed, for example, when starting a cold engine or during acceleration in which a sufficient supply of fresh air is demanded by the engine. To perform EGR when starting an engine leads to a difficulty in starting the engine and EGR during acceleration incurs a danger of production of smoke.

To meet these problems, an EGR system shown in FIG. 1 can be devised. In FIG. 1, an EGR cut-off valve 1 of a pressure responsive type is disposed in an EGR passage 2 connecting an exhaust passage 3 with an induction passage 4 at a portion downstream of a throttle valve 5. Also a by-pass cut-off valve 6 of a pressure responsive type is disposed in a bypass passage 7 which is arranged to detour the throttle valve 5 in the induction passage. These two cut-off valves 1 and 6 are arranged to cooperate in such a manner that the by-pass cut-off valve 6 is open when the EGR cut-off valve 1 is closed so as to increase an intake air amount immediately after EGR is cut off.

In such a system, EGR is cut off by closing the EGR valve 1, for example, when starting the engine, when the engine is cold or during high speed or acceleration, and at the same time a deficiency in intake air amount caused by the cut-off of EGR is compensated for by opening the by-pass cut-off valve 6. For doing this, there is provided a three-way solenoid control valve 8 which is actuated by an output signal from a device 9 for detecting engine operating condition and which is arranged to supply through a passage 10 a negative pressure from a vacuum source 11 or an atmospheric pressure to the EGR valve or the bypass valve 6 alternatively. The detecting device 9 comprises a plurality of sensors such as a speed sensor for detecting the rotational speed of the engine, a sensor for detecting the load of the engine and a sensor for detecting a starting of the engine.

In this EGR system, however, it is necessary to install two valves, that is, the EGR cut-off valve 1 in the EGR passage 2 and the bypass cut-off valve 6 in the bypass passage 7 and this leads to an increase in the number of parts to constitute the system and hence to an increase in cost and a complicated design having an intricate cooperative mechanism.

SUMMARY OF THE INVENTION

It is therefore an object of the present invention to provide an exhaust gas recirculation system in a compression ignition internal combustion engine, featuring a simplification of structure and design and an adequate exhaust gas recirculation control which is adequate to an engine operating condition while maintaining a good performance of the engine operation.

According to the present invention, there are provided two passages in an EGR system in a compression ignition internal combustion engine, that is, a by-pass passage which connects two portions of an induction pasage for air flow to the engine so as to detour a throttle valve disposed in the induction passage and an EGR passage which connects an exhaust passage for exhaust gas flow from the engine to the induction passage downstream of the throttle valve. And these two passages are arranged to join together, to form a junction portion which has a first inlet opening from the by-pass passage, a second inlet opening from the EGR passage and an outlet communicating with the induction passage downstream of the throttle valve. There is provided in this junction portion a valve means which has a first position where the second inlet is closed and the first inlet is open to connect the by-pass passage to the induction passage downstream of the throttle valve and a second position where the first inlet is closed and the second inlet is open to connect the EGR passage to the induction passage downstream of the throttle valve. This valve means is actuated by a valve actuating means for shifting the position of the valve means between the first and second positions in accordance with an engine operating condition indicated by signals produced by a plurality of sensors each of which senses a parameter of engine operating conditions and produces an electric signal representing the sensed parameter.

DESCRIPTION OF THE PREFERRED EMBODIMENTS

Figure 1:
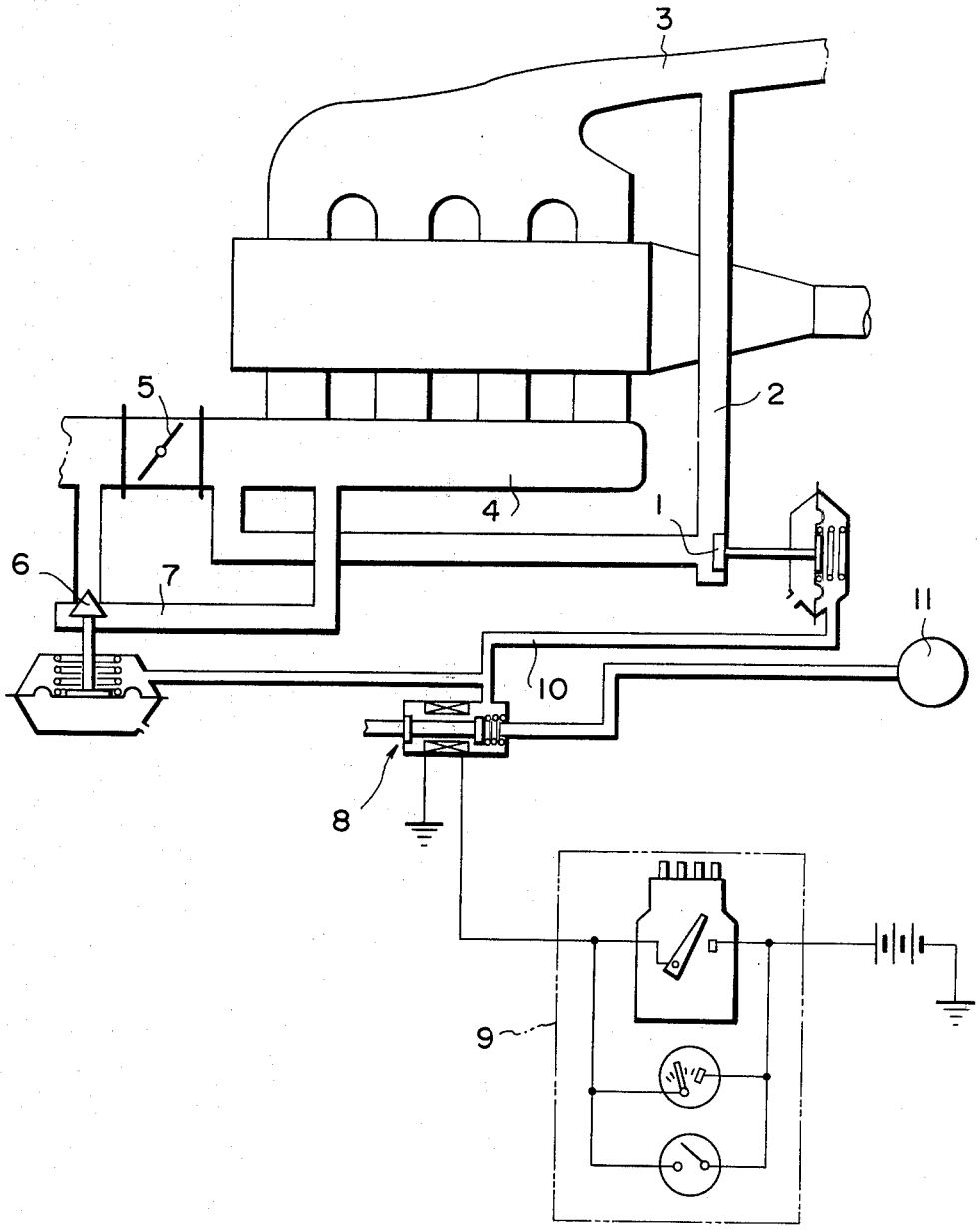
FIG. 1 is schematic illustration of a system to which the present invention is applied.
Figure 2:
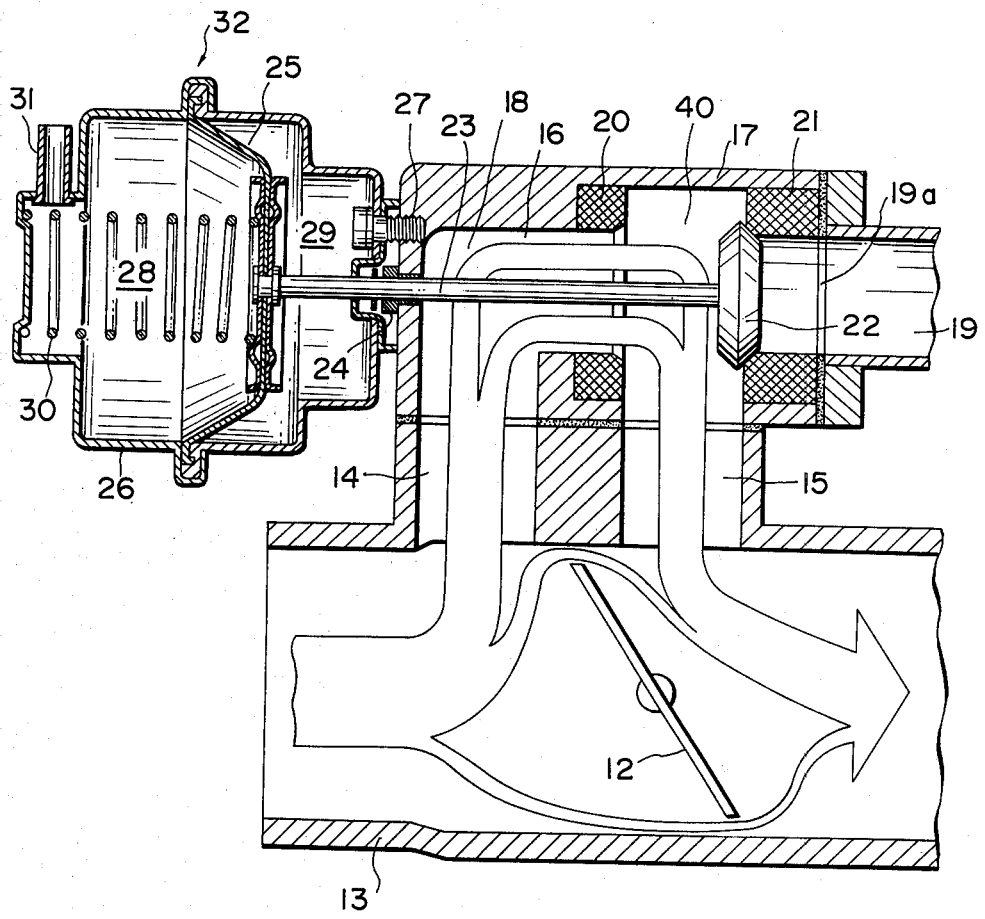
FIG. 2 is a sectional view showing an important part of an embodiment according to the present invention.

Referring to FIG. 2, a throttle valve 12 is disposed in an induction passage 13 and is linked with a control lever of a fuel injector pump (not shown) so as to open the throttle valve 12 in accordance with an increase of the load.

There are provided a first passage portion 14 opening to a portion of the induction passage 13 upstream of the throttle valve 12 and a second passage portion 15 opening to a portion of the induction passage 13 downstream of the throttle valve 12. The first and second passage portions are connected with each other by a third passage portion 16 arranged in a case 17 thus forming a by-pass passage 18 to detour the throttle valve 12. The bypass passage 18 has an open end 19*a* of an EGR passage 19 communicating with an exhaust passage. Thus the EGR passage 19 and the by-pass passage 18 are arranged to join together, forming a junction portion 40 having a first inlet opening from the by-pass passage, a second inlet opening from the EGR passage and an outlet opening into the second passage portion of the by-pass passage.

The case 17 is fixedly attached to the passage 13 with fasteners (not shown) such as bolts and there are provided in the case 17 a first valve seat 20 forcibly and firmly fitted into the first inlet of the junction portion 40 and a second valve seat 21 forcibly and firmly fitted into the second inlet having the same central axis with the first inlet.

A valve head 22 of a poppet type valve is arranged to shift to and fro between the first and second valve seats 20, 21 which are aligned concentrically. Thus the valve has two alternative positions; that is, a first position where the EGR passage is closed and the by-pass passage is open to communicate with a portion of induction passage downstream of the throttle valve 12 by means of the second passage portion 15, and a second position where the by-pass passage is closed and the EGR passage is open to communicate with the induction passage by means of the second passage portion 15. In FIG. 2, the valve is in its first position and air flows by-passing the throttle valve 12 as shown by an arrow.

The valve head 22 is connected to one end of a valve stem 23. The other end of the valve stem 23 protrudes through a collar 24 out of the case 17 and is connected to a diaphragm 25 disposed in a housing 26 fastened to the case 17 with bolts 27.

The diaphragm 25 divides the housing 26 into two chambers; that is, a negative pressure control chamber 28 and an atmospheric pressure chamber 29. The negative pressure chamber 28 has a spring 30 therein and an open end of a vacuum passage 31 communicating with a vacuum source, for example, a vacuum pump, via an electromagnetic control valve. The electromagnetic valve changes a pressure introduced into the vacuum passage 31 from vacuum to atmospheric pressure and vice versa in response to output signals from a detecting device which comprises a plurality of sensors each for sensing a parameter of engine operating conditions. This means for actuating the valve in response to the signals from the detecting device is referred to as a vacuum actuator 32.

The amount of recirculated exhaust gases can be controlled satisfactorily by the throttle valve 12 only.

In the thus designed EGR system, if the detecting device detects the engine operating conditions where EGR is not needed, for example, before the engine has reached a desired temperature or during a high speed high load condition, then the detecting device produces output signals and the output signals actuate the electromagnetic valve to change its state so as to introduce an atmospheric pressure through the vacuum passage 31 to the vacuum control chamber 28 of the vacuum actuator 32.

Thus the vacuum control chamber 28 is filled with an atmospheric air and hence the diaphragm 25 is deflected to the right in FIG. 2 by the restoring force of the spring 30, pushing the valve stem 23 and the valve head 22 to the right and thus bringing the valve head 22 to the rest position of the valve seat 21, that is, the first position of the valve.

In this state of the valve, the EGR passage 19 is closed and the by-pass passage is open and therefore air flows bypassing the throttle valve 12 so that an intake air is supplied sufficiently irrespective of the opening degree of the throttle valve 12 under the above mentioned engine operating conditioins.

On the other hand, under engine operating conditions, such as a frequently used low and medium speed range where the engine has been warmed up and EGR is desired, the electromagnetic valve is actuated to change its state by the detecting device, so as to introduce a negative pressure from the vacuum source to the vacuum control chamber 28.

Owing to the negative pressure in the vacuum chamber 28, the diaphragm 25 is deflected to the left in FIG. 2 against the spring 30, thus bringing the valve head 22 to the rest position of the valve seat 20, that is, the second position of the valve.

Thus the by-pass passage 18 is closed and the EGR passage 19 is open and therefore exhaust gases are recirculated. The quantity of EGR is controlled in accordance with the opening degree of the throttle valve 12 (namely, the load condition).

Figure 3:
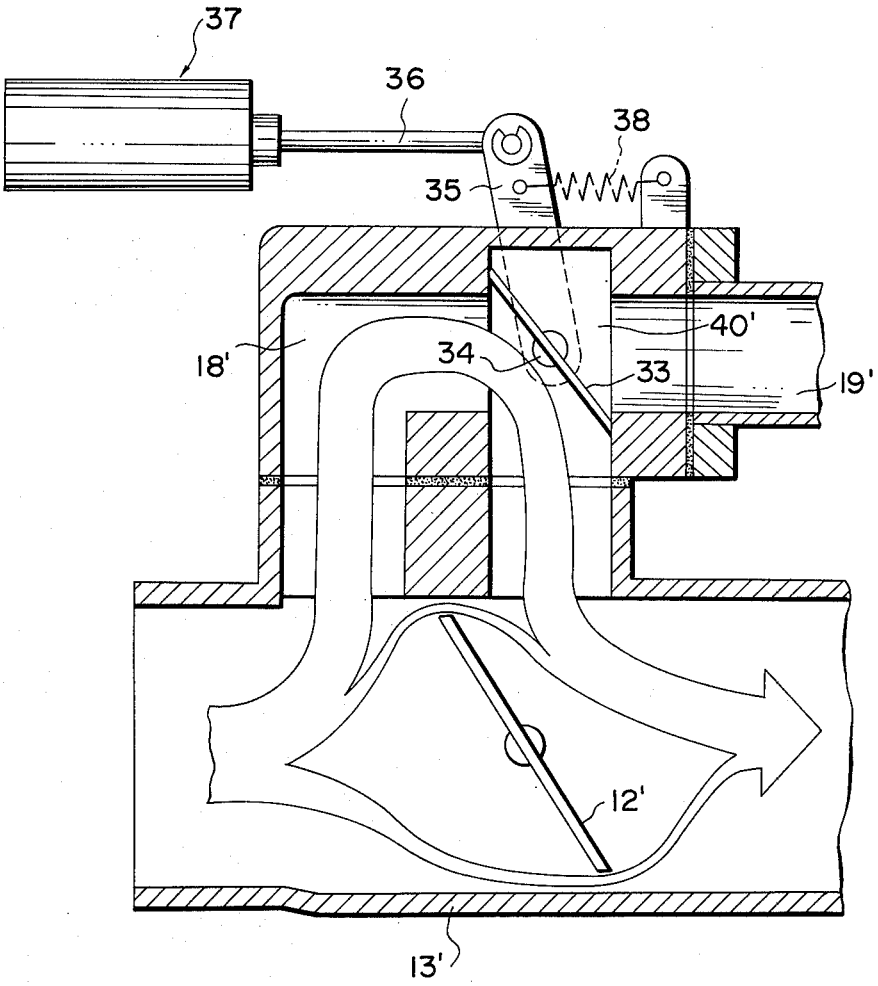
FIG. 3 is a sectional view showing an important part of another embodiment according to the present invention.

FIG. 3 shows another embodiment of the present invention. The difference from FIG. 2 is that a butterfly type valve is adapted to change passages.

In FIG. 3, a butterfly valve 33 is fixed to a rotary shaft 34 placed at a junction portion 40' of a by-pass passage 18' and an EGR passage 19'. A lever 35 is fixedly connected to the rotary shaft 34 and a movable end of the lever 35 is pivotally connected to a rod 36 of an electromagnetic actuator 37.

In this arrangement, when the electromagnetic actuator 37 is energized and pulls the rod 36, the butterfly valve 33 rotates counterclockwise to connect the by-pass passage 18' to an induction passage 13' downstream of a throttle valve 12' and at the same time closes the EGR passage 19'. When deenergized, a return spring 38 pulls the movable end of the lever 35 and the butterfly valve 33 rotates clockwise to cut off the by-pass passage 18' and open the EGR passage 19'.

Since the electromagnetic actuator is adopted in this embodiment, there is no need for a vacuum source and therefore the number of parts can be further reduced.

According to the present invention, as explained above, a by-pass passage detouring the throttle valve is arranged to join an EGR passage opening into a portion of the induction passage downstream of the throttle valve and there is provided at the junction of the by-pass passage and the EGR passage a single valve which is actuated in accordance with engine operating conditions and controls the opening and closure of the two passages between two mutually exclusive states where only either one of the two passages is closed and the other is open. Accordingly the present invention makes it possible to achieve an adequate EGR control in accordance with engine operating conditions while maintaining a good performance of the engine operation and also makes it possible to simplify the linking mechanism with a reduced number of parts and to reduce the manufacturing and maintenance costs.

What is claimed is:

1. A system for recirculation of exhaust gases in a compression-ignition internal combustion engine having an induction passage for air flow to the engine, an exhaust passage for exhaust gas flow from the engine and a throttle valve disposed in the induction passage, the system comprising:

an exhaust gas recirculation passage connecting the exhaust passage with the induction passage downstream of the throttle valve, a by-pass passage connecting two portions of the induction passage to detour the throttle valve, said exhaust gas recirculation passage and said by-pass passage being arranged to join together forming a junction portion having a first inlet opening from said by-pass passage, a second inlet opening from said exhaust gas recirculation passage and an outlet communicating with the induction passage downstream of the throttle valve, valve means disposed in said junction portion, said valve means having a first position where said second inlet is closed and said first inlet is open to connect said by-pass passage to the induction passage downstream of the throttle valve and a second position where said first inlet is closed and said second inlet is open to connect said exhaust gas recirculation passage to the induction passage downstream of the throttle valve, a plurality of sensors each for sensing a parameter of engine operating conditions and producing an electric signal representing the sensed parameter, and valve actuating means for shifting the position of said valve means between said first and second positions in accordance with an engine operating condition indicated by the signals produced by said sensors.

2. A system as claimed in claim 1, wherein said first inlet and said second inlet are aligned concentrically.

3. A system as claimed in claim 2, wherein said valve means is a poppet type valve comprising a first valve seat secured in said first inlet, a second valve seat secured in said second inlet, and a valve head movable to and fro between said two valve seats thereby to open and close said two inlets alternatively.

4. A system as claimed in claim 1 or 3, wherein said valve actuating means is a vacuum actuator comprising a flexible pressure responsive diaphragm which serves as a partition between a vacuum control chamber and an atmospheric pressure chamber in a housing, a spring biasing said diaphragm to one direction, vacuum supplying means for introducing a negative pressure into said vacuum control chamber to deflect said diaphragm to the other direction against the biasing force of said spring in accordance with an engine operating condition indicated by the signals produced by said sensors and a linkage means for transmitting the movement of said diaphragm to said valve means thereby to shift the position of said valve means.

5. A system as claimed in claim 1, wherein said valve means is a butterfly type valve comprising a rotatable shaft disposed in said junction portion and a disc rotatable with said shaft to open and close said two inlets alternatively.

6. A system as claimed in claim 1 or 5, wherein said valve actuating means comprising an electromagnetic actuator having a rod to be pulled toward the central portion of said electromagnetic actuator when energized in accordance with an engine operating condition indicated by the signals produced by said sensors, a spring normally biasing said rod away from the central portion of said electromagnetic actuator and a linkage means for transmitting the movement of said rod to said valve means thereby to shift the position of said valve means.

7. A system as claimed in claim 1, wherein one of said sensors is a sensor for detecting the rotational speed of the engine.

8. A system as claimed in claim 1, wherein one of said sensors is a sensor for detecting the load of the engine.

9. A system as claimed in claim 1, wherein one of said sensors is a sensor for detecting a starting of the engine.

* * * * *